US009635929B1

(12) United States Patent
Wu

(10) Patent No.: US 9,635,929 B1
(45) Date of Patent: May 2, 2017

(54) FOLDABLE TABLE

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 0 days.

(21) Appl. No.: 15/062,600

(22) Filed: Mar. 7, 2016

(51) Int. Cl.

| | |
|---|---|
| ***A47F 5/12*** | (2006.01) |
| ***A47B 9/00*** | (2006.01) |
| ***A47B 9/16*** | (2006.01) |
| ***A47B 3/02*** | (2006.01) |
| ***A47B 13/08*** | (2006.01) |
| ***A47B 9/06*** | (2006.01) |
| ***A47B 21/02*** | (2006.01) |

(52) U.S. Cl.
CPC ..... *A47B 9/00* (2013.01); *A47B 3/02* (2013.01); *A47B 9/06* (2013.01); *A47B 9/16* (2013.01); *A47B 13/081* (2013.01); *A47B 21/02* (2013.01); *A47B 2003/025* (2013.01)

(58) Field of Classification Search
CPC .... A47B 2200/0046; A47B 2200/0042; A47B 2200/0041; A47B 9/16; A47B 21/02; A47B 21/00
USPC ..... 108/6, 9, 10, 145; 248/454, 455, 456, 248/398, 407
See application file for complete search history.

(56) References Cited

U.S. PATENT DOCUMENTS 4,194,452 A * 3/1980 Crowther ..... A47B 9/00 108/138
4,635,893 A * 1/1987 Nelson ..... A47B 21/02 248/558
4,926,760 A * 5/1990 Sack ..... B66F 7/0666 108/145
4,934,647 A * 6/1990 Edwards ..... F16M 11/046 108/10
5,375,536 A * 12/1994 Peters ..... A47B 23/002 108/23
6,220,660 B1 * 4/2001 Bedro ..... B60N 2/468 108/44
7,677,518 B2 * 3/2010 Chouinard ..... A47B 21/02 108/10
8,985,031 B2 * 3/2015 Gillotti ..... A47B 9/16 108/10
9,113,703 B2 * 8/2015 Flaherty
9,241,577 B1 * 1/2016 Shea ..... A47C 21/028
2007/0163475 A1 * 7/2007 Murphy ..... A47B 9/00 108/147
2011/0056412 A1 * 3/2011 Grammer ..... A45C 9/00 108/6

(Continued)

*Primary Examiner* — Jose V Chen
(74) *Attorney, Agent, or Firm* — Birch, Stewart, Kolasch & Birch, LLP

(57) ABSTRACT

A foldable table has a base, a lifting device, an adjusting assembly, and a supporting board. The adjusting assembly is pivotally connected with the lifting device and has an adjusting board, an adjusting rack, an adjusting slider, and a connection arm. The adjusting board is pivotally connected with the lifting device. The adjusting rack is mounted on the adjusting board and has an engaging side provided with multiple teeth. The adjusting slider is moveably mounted on the adjusting board and has an engaging block and two resilient elements. The engaging block is pivotally mounted on the adjusting slider and has an engaging post selectively engaging with one of the teeth on the adjusting rack. The supporting board is pivotally connected with the adjusting board and is pivotally connected with the top end of the connection arm.

16 Claims, 15 Drawing Sheets

(56) References Cited

U.S. PATENT DOCUMENTS

| | | | | |
|---|---|---|---|---|
| 2013/0112829 | A1* | 5/2013 | Stengel | F16M 13/022<br>248/297.31 |
| 2013/0263762 | A1* | 10/2013 | Chang | A47B 17/00<br>108/2 |
| 2015/0289641 | A1* | 10/2015 | Ergun | A47B 9/16<br>108/42 |

* cited by examiner

FOLDABLE TABLE

BACKGROUND OF THE INVENTION

1. Field of the Invention

The present invention relates to a table, and more particularly to a foldable table.

2. Description of Related Art

A conventional office table always has a fixed height and is not adjustable in height to fit with different users. Therefore, the conventional office table is not comfortable and convenient in use for a tall or short user. In addition, the conventional office table is not adjustable in an inclined angle of a portable device put on the table, such as a notebook computer or a tablet computer, so the conventional office table is not convenient in use.

To overcome the shortcomings, the present invention tends to provide a fordable table to mitigate or obviate the aforementioned problems.

SUMMARY OF THE INVENTION

The main objective of the invention is to provide a foldable table that is adjustable to be lifted to different heights and expanded to different angles and is convenient and versatile in use.

The foldable table has a base, a lifting device, an adjusting assembly, and a supporting board. The lifting device is mounted on the base and has a top. The adjusting assembly is pivotally connected with the lifting device and has an adjusting board, an adjusting rack, an adjusting slider, and a connection arm. The adjusting board is pivotally connected with the top of the lifting device. The adjusting rack is mounted on the adjusting board and has an engaging side provided with multiple teeth and a flat side opposite the engaging side. The adjusting slider is moveably mounted on the adjusting board and has a bottom, an engaging block, and two resilient elements. The engaging block is pivotally mounted on the bottom of the adjusting slider and has an engaging post formed on the engaging block and selectively engaging with one of the teeth on the adjusting rack. The two resilient elements are mounted on the bottom of the adjusting slider and are connected respectively with two sides of the engaging block. The connection arm has a top end and a bottom end, the bottom end connected pivotally with the adjusting slider. The supporting board is pivotally connected with the adjusting board, is pivotally connected with the top end of the connection arm, and has a pivoting edge and a supporting block. The pivoting edge is pivotally connected with the adjusting board. The supporting block is pivotally mounted on the pivoting edge of the supporting board.

Other objects, advantages and novel features of the invention will become more apparent from the following detailed description when taken in conjunction with the accompanying drawings.

DETAILED DESCRIPTION OF PREFERRED EMBODIMENT

Figure 1:
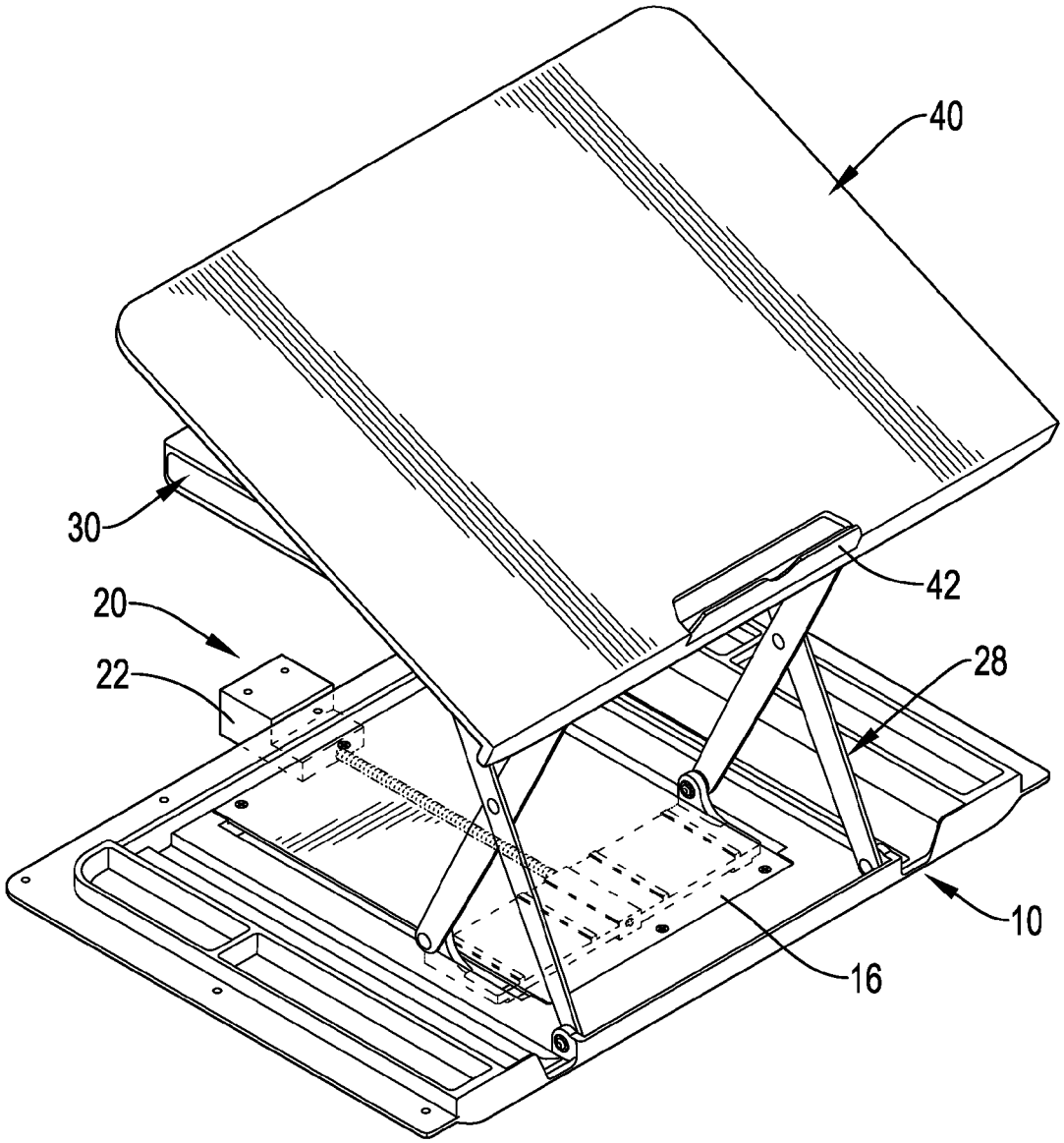
FIG. 1 is a perspective view of a first embodiment of a foldable table in accordance with the present invention in an expanded state.
Figure 3:
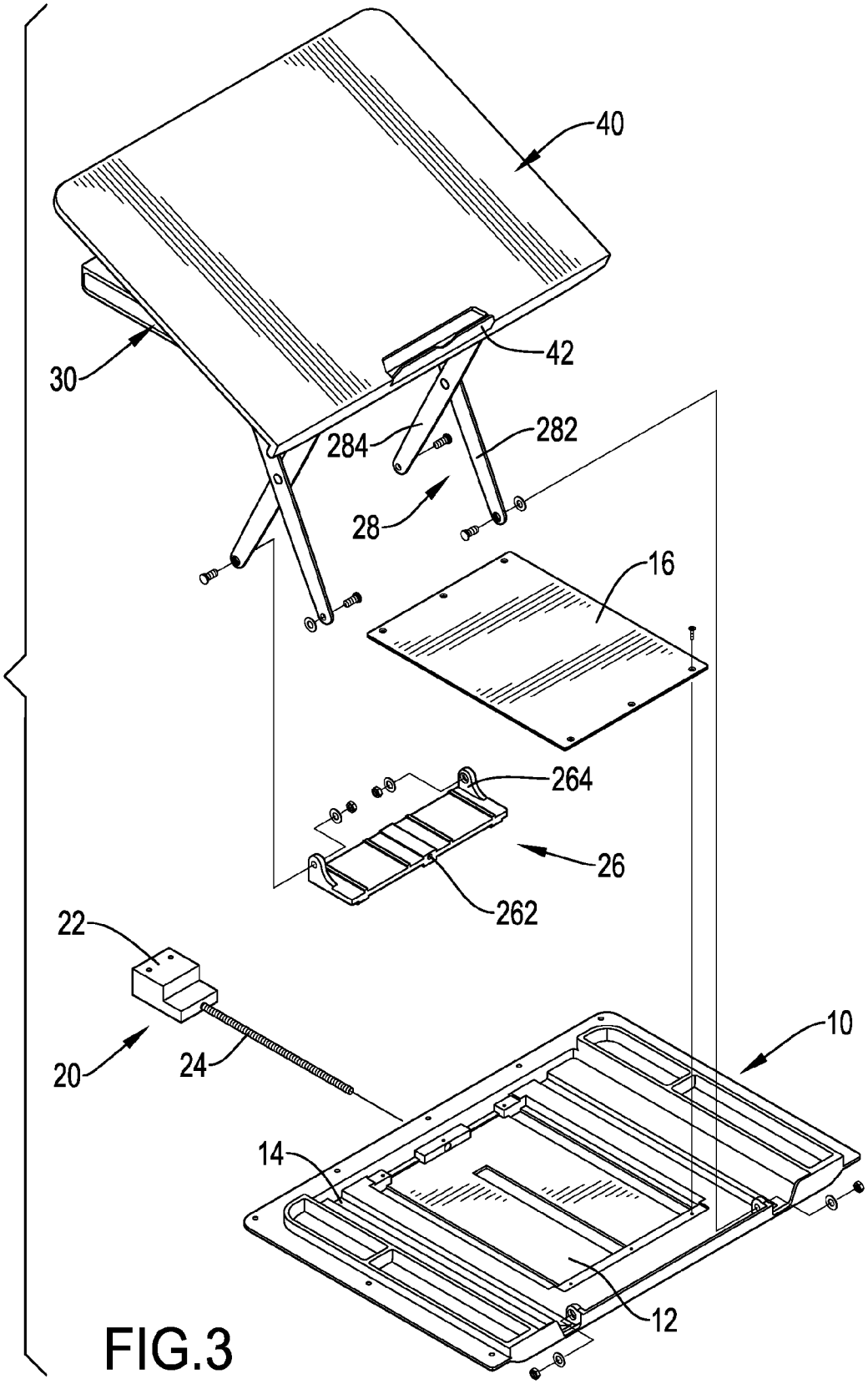
FIG. 3 is a partially exploded perspective view of the foldable table in FIG. 1.
Figure 4:
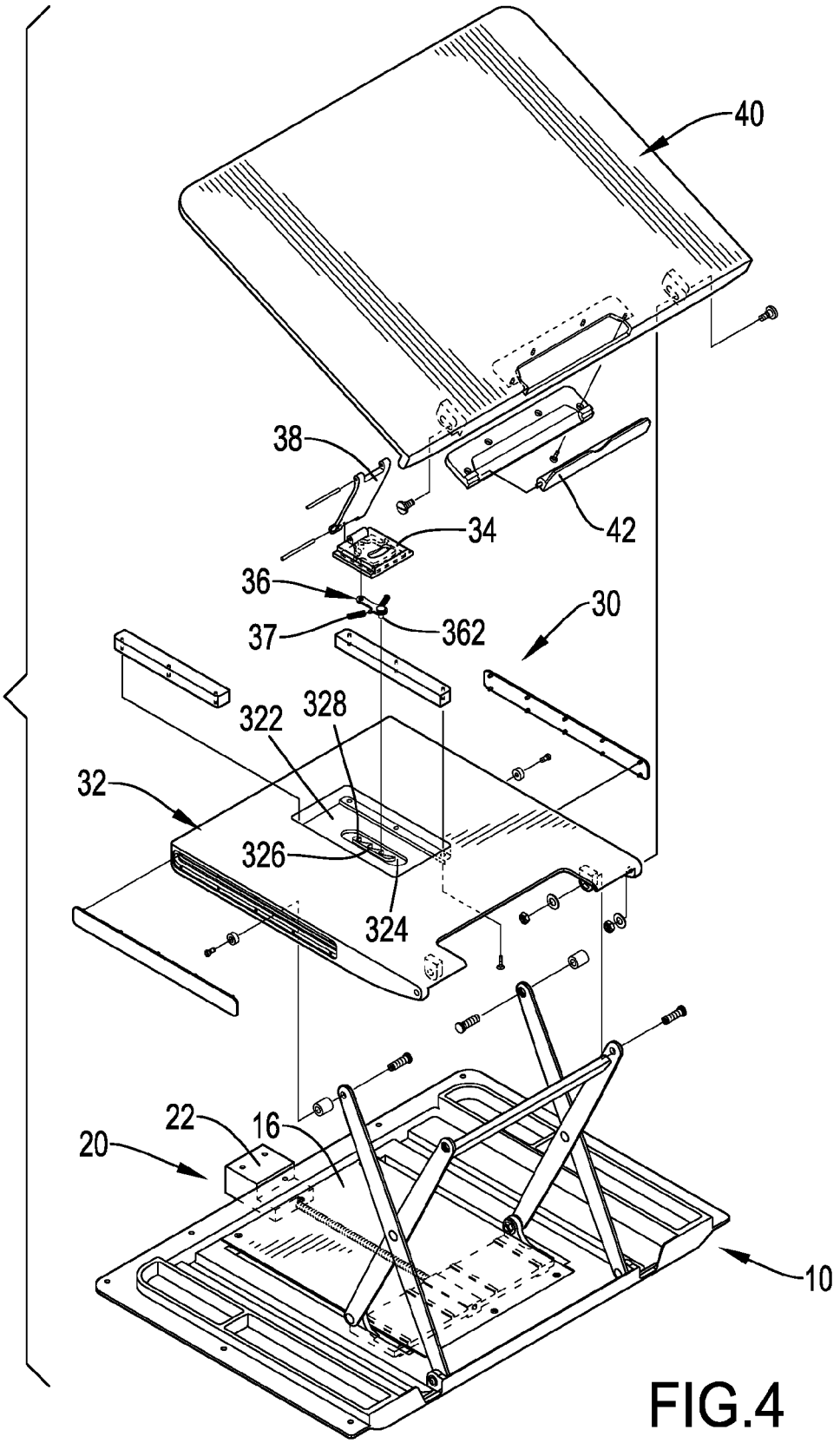
FIG. 4 is another partially exploded perspective view of the foldable table in FIG. 1.

With reference to FIGS. 1, 3, and 4, a first embodiment of a foldable table in accordance with the present invention comprises a base 10, a lifting device 20, an adjusting assembly 30, and a supporting board 40. The base 10 may be a quadrilateral board and has a top and a base recess 12 defined in the top. The base recess 12 has two opposite sides and two rails 14 mounted respectively on the two opposite sides of the base recess 12 and being parallel with each other.

Figure 5:
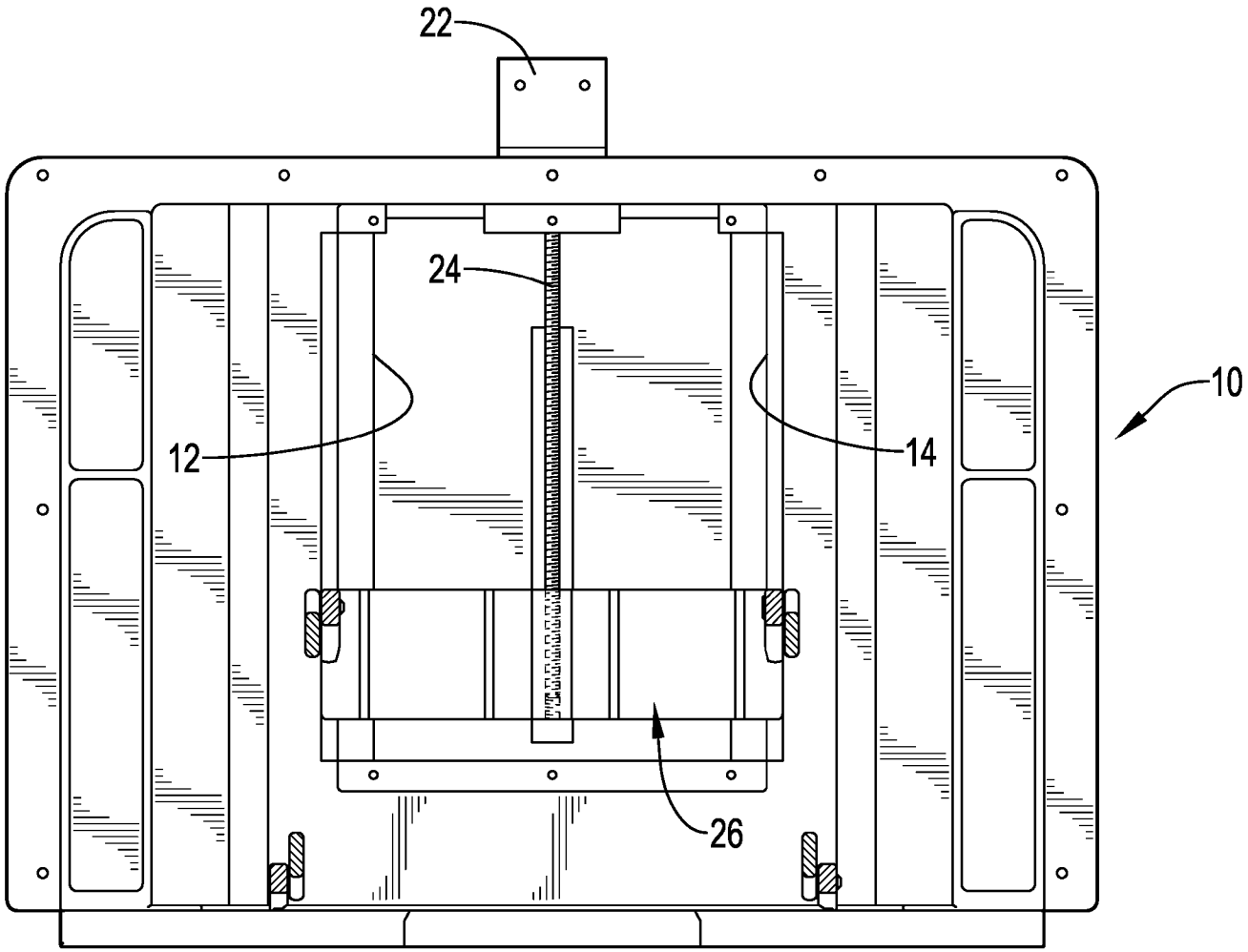
FIG. 5 is a cross sectional top view of the foldable table in FIG. 1.

With reference to FIGS. 3 and 5, the lifting device 20 is mounted on the base 10, has a top, and comprises a driving device 22, a threaded rod 24, a moving base 26, and multiple lifting rods 28. The driving device 22 is mounted on the base 10 and may comprise a motor and a gearbox. The threaded rod 24 is mounted rotatably on the base 10 and is connected with and driven by the driving device 22. Preferably, the threaded rod 24 extends into the base recess 12 and is parallel with the rails 14 in the base recess 12. The moving base 26 is mounted moveably on the base 10 and has a threaded hole 262 screwed with the threaded rod 24. Preferably, the moving base 26 is moveably mounted in the base recess 12, and two sides of the moving base 26 are moveably connected with the rails 14. Accordingly, when the driving device 22 is switched on, the threaded rod 24 is rotated and the moving base 26 is moved in the base recess 12 along the rails 14. The lifting rods 28 are divided into multiple pairs, and each pair of the lifting rods 28 includes a first lifting rod 282 and a second lifting rod 284 pivotally connected with the first lifting rod 282. The first lifting rod 282 of each pair of the lifting rods 28 is pivotally connected with the base 10, and the second lifting rod 284 of each pair of the lifting rods 28 is pivotally connected with the moving base 26. In addition, the moving base 26 further has multiple pivotal ears 264 formed on and protruding from the moving base 26 and pivotally connected with the second lifting rods 284 of the pairs of the lifting rods 28. Preferably, the multiple lifting rods 28 are implemented as four in amount. Furthermore, the base 10 further has a top cover 16 mounted on the top of the base 10 and closing the base recess 12 to cover the threaded rod 24 and the moving base 26.

Figure 6:
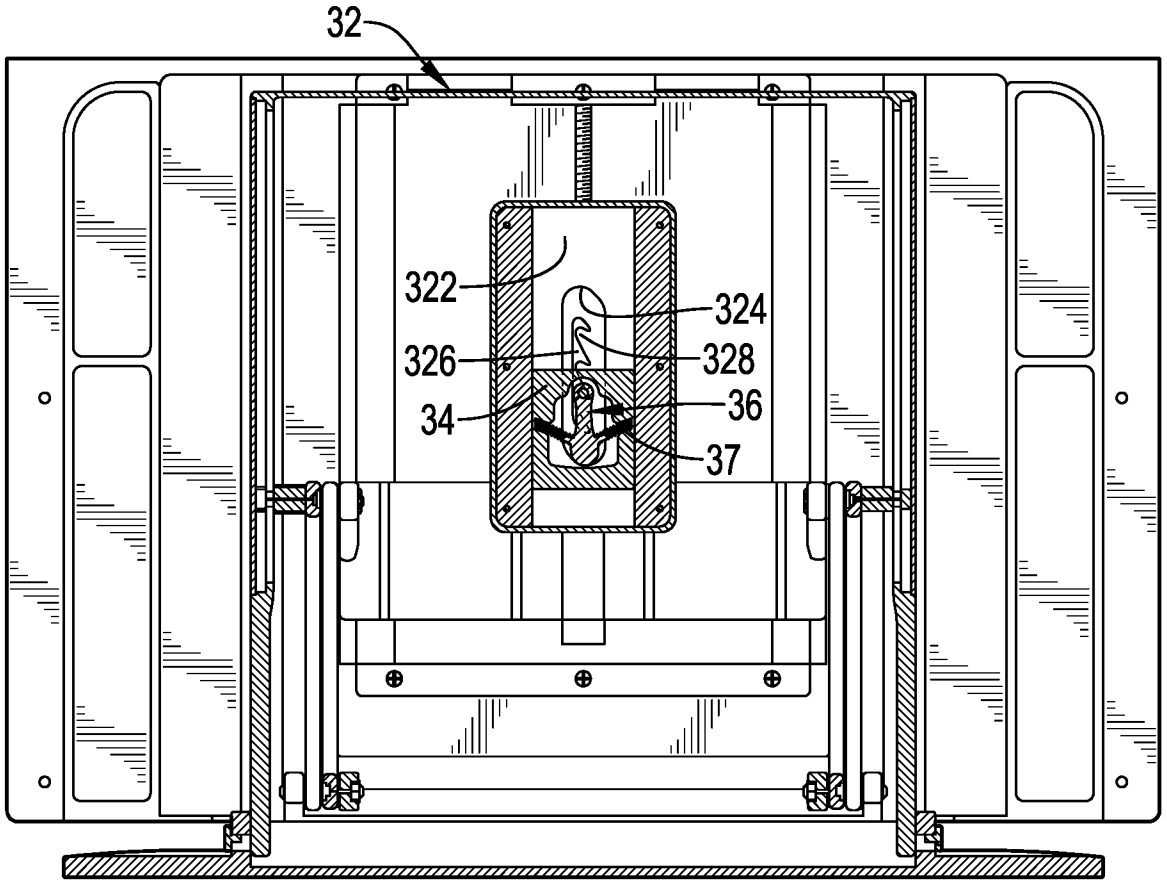
FIG. 6 is another cross sectional top view of the foldable table in FIG. 1.
Figure 7:
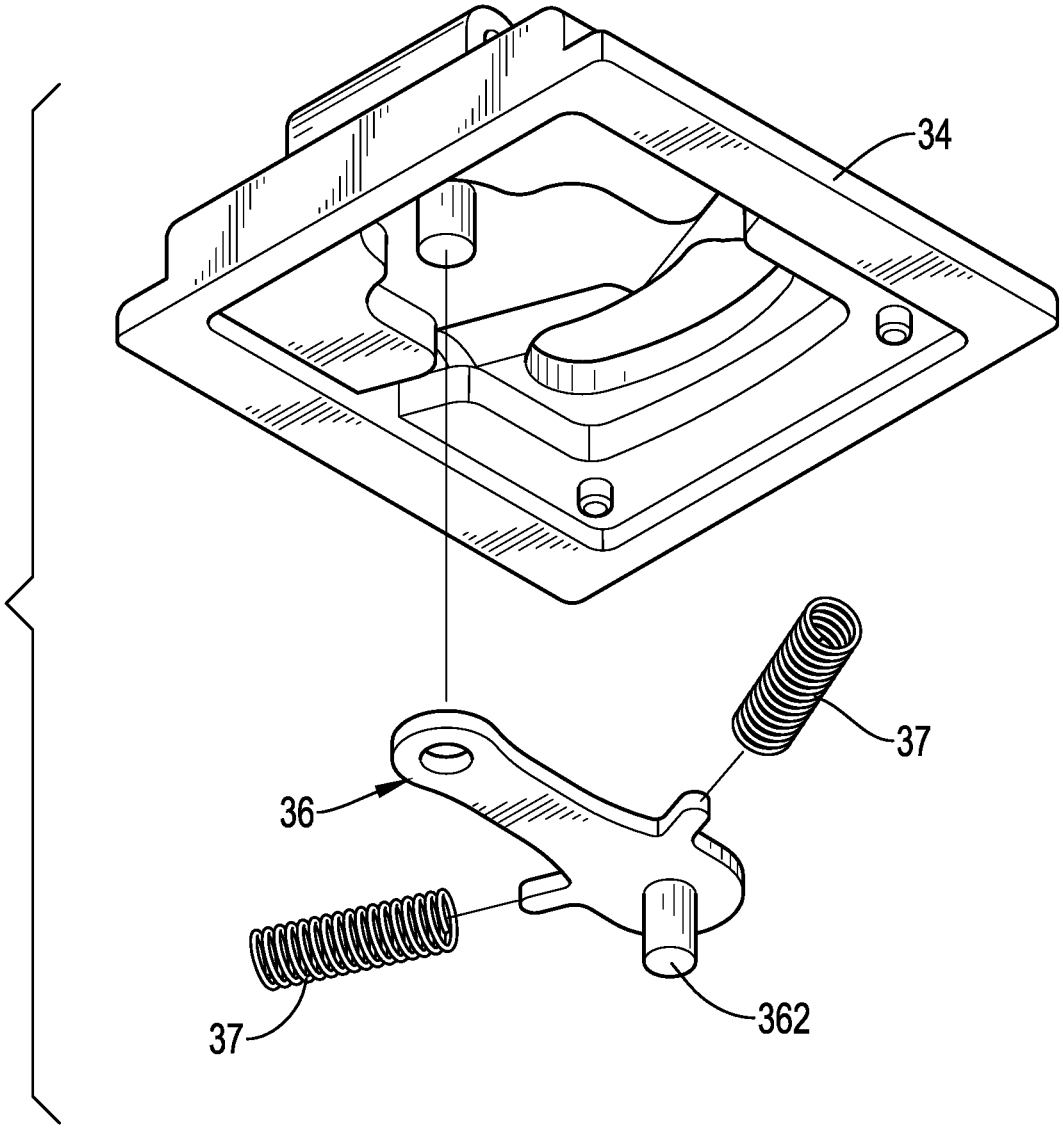
FIG. 7 is an enlarged exploded perspective view of the adjusting slider of the foldable table in FIG. 4.

With reference to FIGS. 4, 6, and 7, the adjusting assembly 30 is pivotally connected with the lifting device 20, is driven by the lifting device 20 to move upward and downward, and comprises an adjusting board 32, an adjusting rack 326, an adjusting slider 34, and a connection arm 38. The adjusting board 32 is pivotally connected with the top of the lifting device 20 and is preferably connected pivotally with the tops of the lifting rods 28. The first lifting rod 282 of each pair of the lifting rods 28 is slidably connected with the adjusting board 32. The adjusting board 32 has a top and a sliding recess 322 defined in the top of the adjusting board 32 and having a bottom. A rack recess 324 is defined in the bottom of the sliding recess 322 and has a bottom and two opposite sides. The adjusting rack 326 is mounted on the adjusting board 32 and is preferably mounted on the bottom of the rack recess 324. The adjusting rack 326 has an engaging side provided with multiple teeth 328 and a flat side opposite the engaging side. The engaging side and the flat side of the adjusting rack 326 are spaced respectively from the two opposite sides of the rack recess 324 to define two sliding channels between the rack recess 324 and the adjusting rack 326. Preferably, the adjusting rack 326 has two curved ends.

The adjusting slider 34 is moveably mounted on the adjusting board 32 and is preferably mounted moveably in the sliding recess 322. The adjusting slider 34 has a bottom, an engaging block 36, and two resilient elements 37. The engaging block 36 is pivotally mounted on the bottom of the adjusting slider 34 and has an engaging post 362 formed on the engaging block 36 and selectively engaging with one of the teeth 328 on the adjusting rack 326. The resilient elements 37 are mounted on the bottom of the adjusting slider 34 and are connected respectively with two sides of the engaging block 36. Preferably, each resilient element 37 may be a spring or a resilient block. The connection arm 38 has a top end and a bottom end, the bottom end connected pivotally with the adjusting slider 34.

The supporting board 40 is pivotally connected with the adjusting board 32, is pivotally connected with the top end of the connection arm 38, and has a pivoting edge and a supporting block 42. The pivoting edge is pivotally connected with the adjusting board 32. The supporting block 42 is pivotally mounted on the pivoting edge of the supporting board 40.

Figure 8:
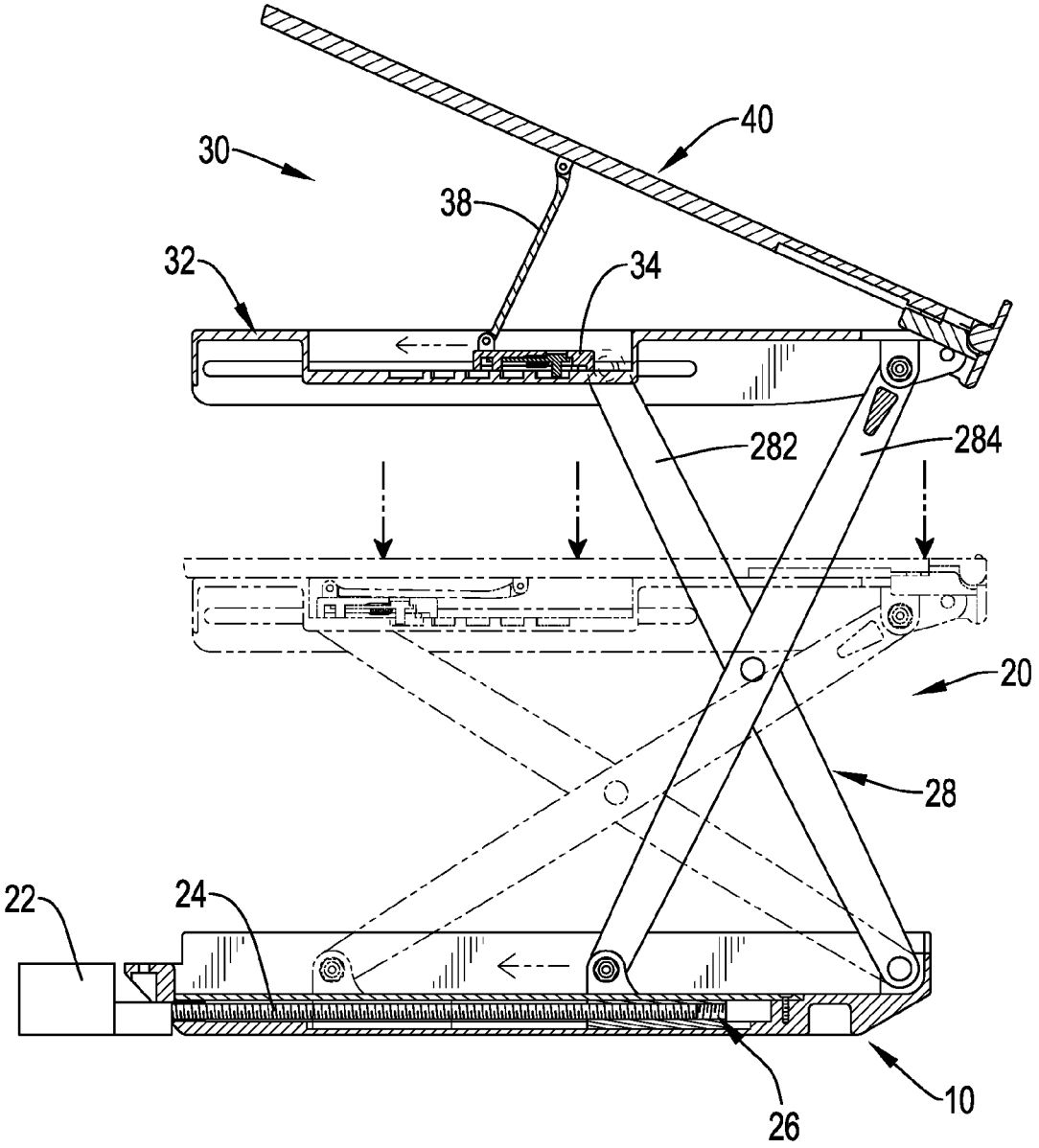
FIG. 8 is an operational side view in partial section of the foldable table in FIG. 1.
Figure 9:
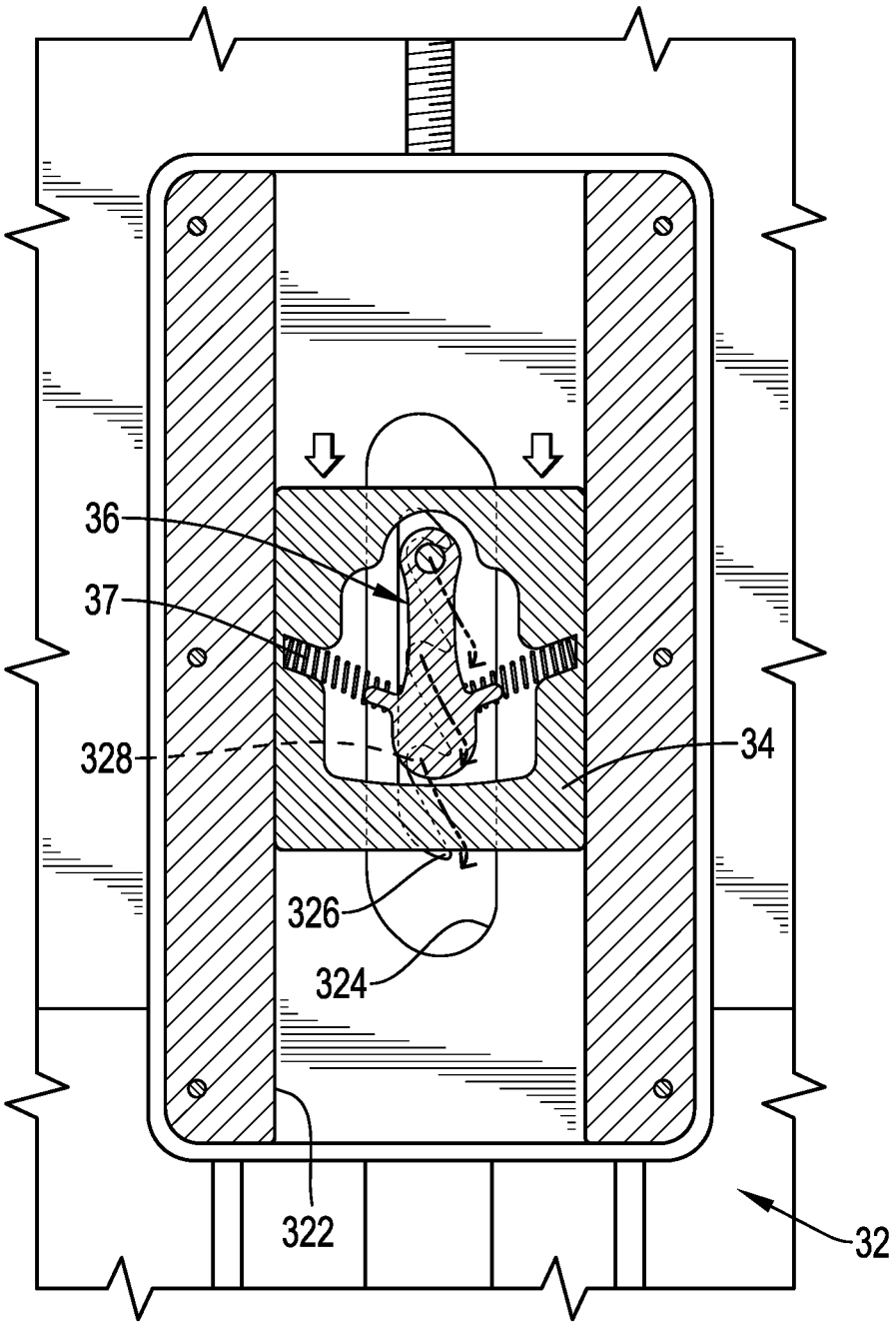
FIG. 9 is an enlarged operational top view in partial section of the adjusting slider of the foldable table in FIG. 4.

With reference to FIGS. 5 and 8, when the motor of the driving device 22 is turned on, the threaded rod 24 is rotated and the moving base 26 is moved relative to the base 10 along the rail 14. With the movement of the moving base 26, the lifting rods 28 are moved and pivoted to lift the adjusting board 32 and the supporting board 40 upward to a desired height. When the motor is turned off, the adjusting board 32 can be moved and positioned at the desired height. The supporting board 40 is then pivoted relative to the adjusting board 32. With reference to FIG. 9, with the pivotal rotation of the supporting board 40, the adjusting slider 34 is moved along the adjusting rack 326 via the transmission of the connection arm 38. While the adjusting slider 34 is moving along the adjusting rack 326, the engaging post 362 on the engaging block 36 will move over the teeth 328 on the engaging side of the adjusting rack 326 with the resilient force provided by the resilient elements 37. When the supporting board 40 is pivoted to a desired angle relative to the adjusting board 32 and is stopped pivoting, the engaging post 362 on the engaging block 36 will engage with one of the teeth 328 with the resilient force provided by the resilient elements 37. Accordingly, the supporting board 40 is positioned at the desired angle relative to the adjusting board 32. With the supporting block 42 being pivoted relative to the supporting board 40, a portable device, such as a notebook computer or a tablet computer can be put on the inclined supporting board 40 to allow a user to use and operate the portable device on the inclined supporting board 40. With the arrangement of the supporting block 42, the portable device can be kept from falling from the inclined supporting board 40.

Figure 2:
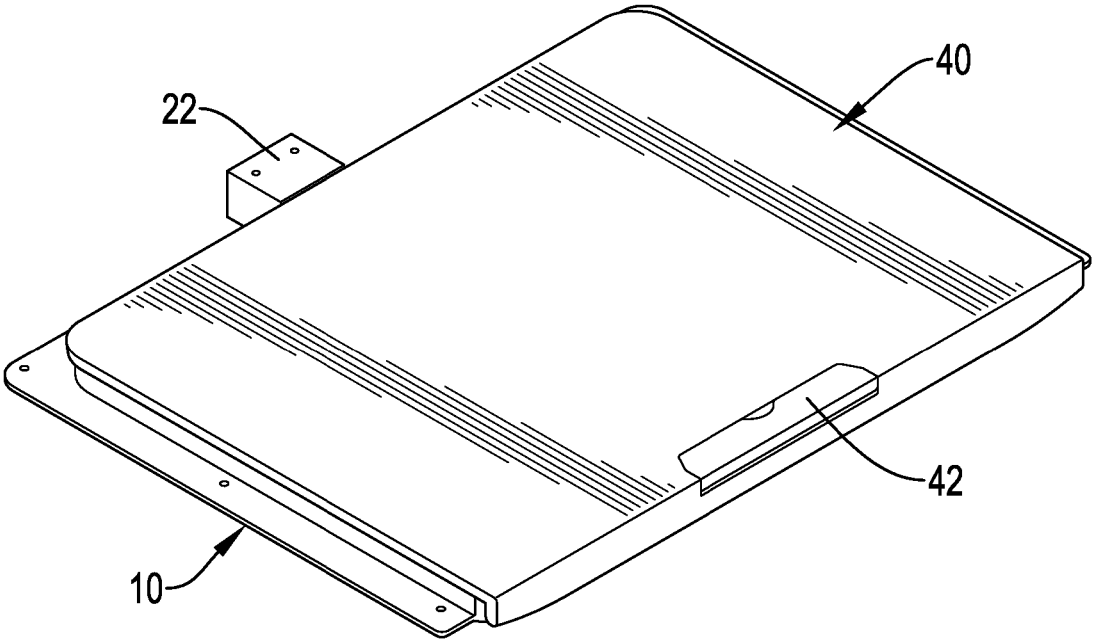
FIG. 2 is a perspective view of the foldable table in FIG. 1 in a folded state.
Figure 10:
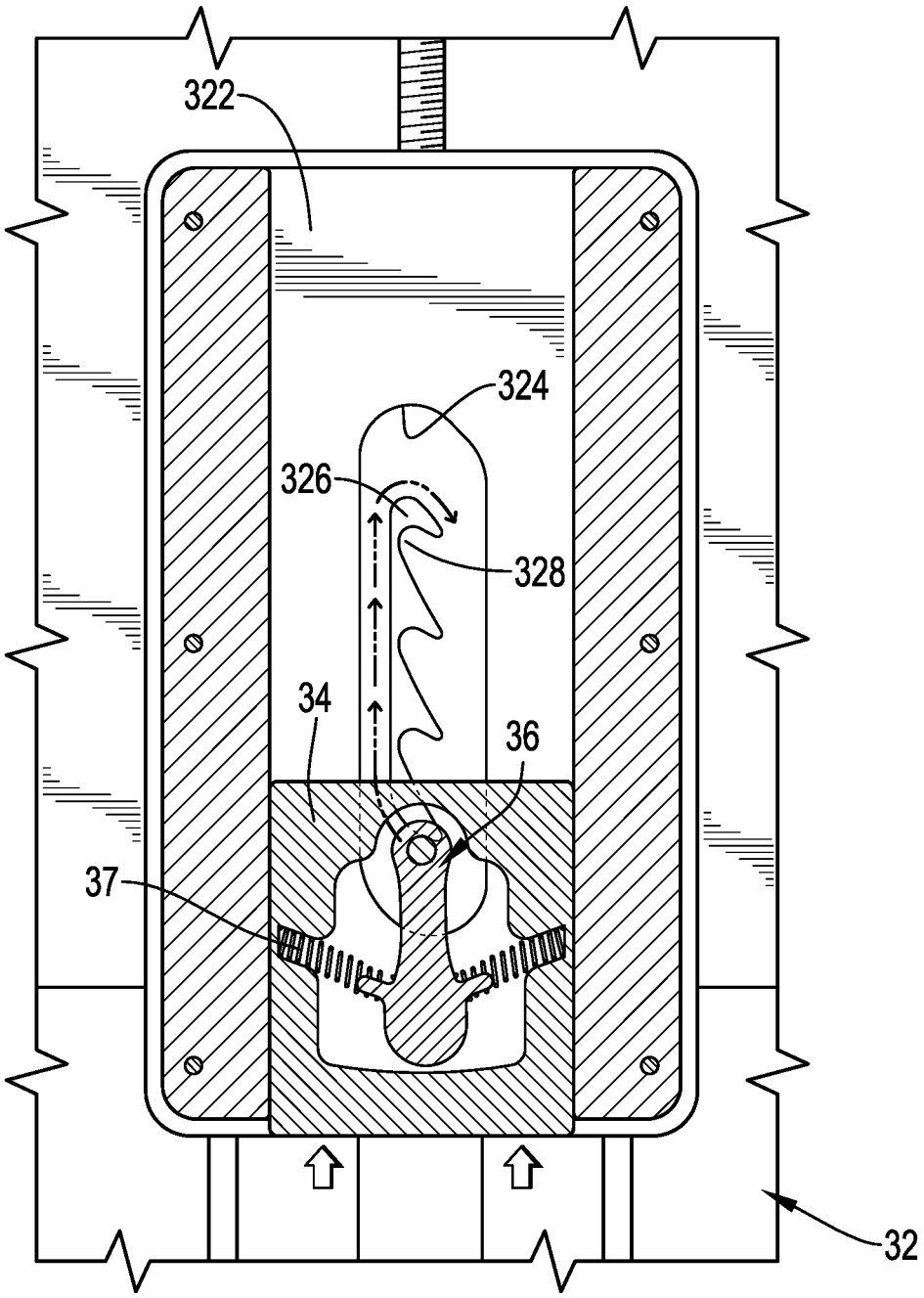
FIG. 10 is another enlarged operational top view in partial section of the adjusting slider of the foldable table in FIG. 4.

When the table is not in use, with reference to FIGS. 4, 8, and 10, the supporting board 40 is pivoted upward to a maximum angle relative to the adjusting board 32. At this time, the engaging post 362 on the engaging block 36 is moved over one of the curved ends of the adjusting rack 326. Then, the supporting board 40 is pivoted downward, and the engaging post 362 is moved to and over the other end of the adjusting rack 326 along the flat side of the adjusting rack 326 to the engaging side having the teeth 328. At this time, the supporting board 40 is stacked with the adjusting board 32. The motor of the driving device 22 is then turned on to rotate in reverse, and the moving base 26 is moved toward the driving device 22. With the movements and pivotal rotations of the lifting rods 28, the adjusting board 32 and the supporting board 40 are moved downward flush with each other to stack with the base 10 as shown in FIG. 2. Consequently, the table can be folded to a minimum volume, such that the folded table is easily carried and stored.

With such an arrangement, the height of the adjusting board 32 and the supporting board 40 and the angle of the supporting board 40 relative to the adjusting board 32 can be adjusted to fit with different needs of different users. Accordingly, the foldable table in accordance with the present invention is comfortable and convenient in use.

Figure 11:
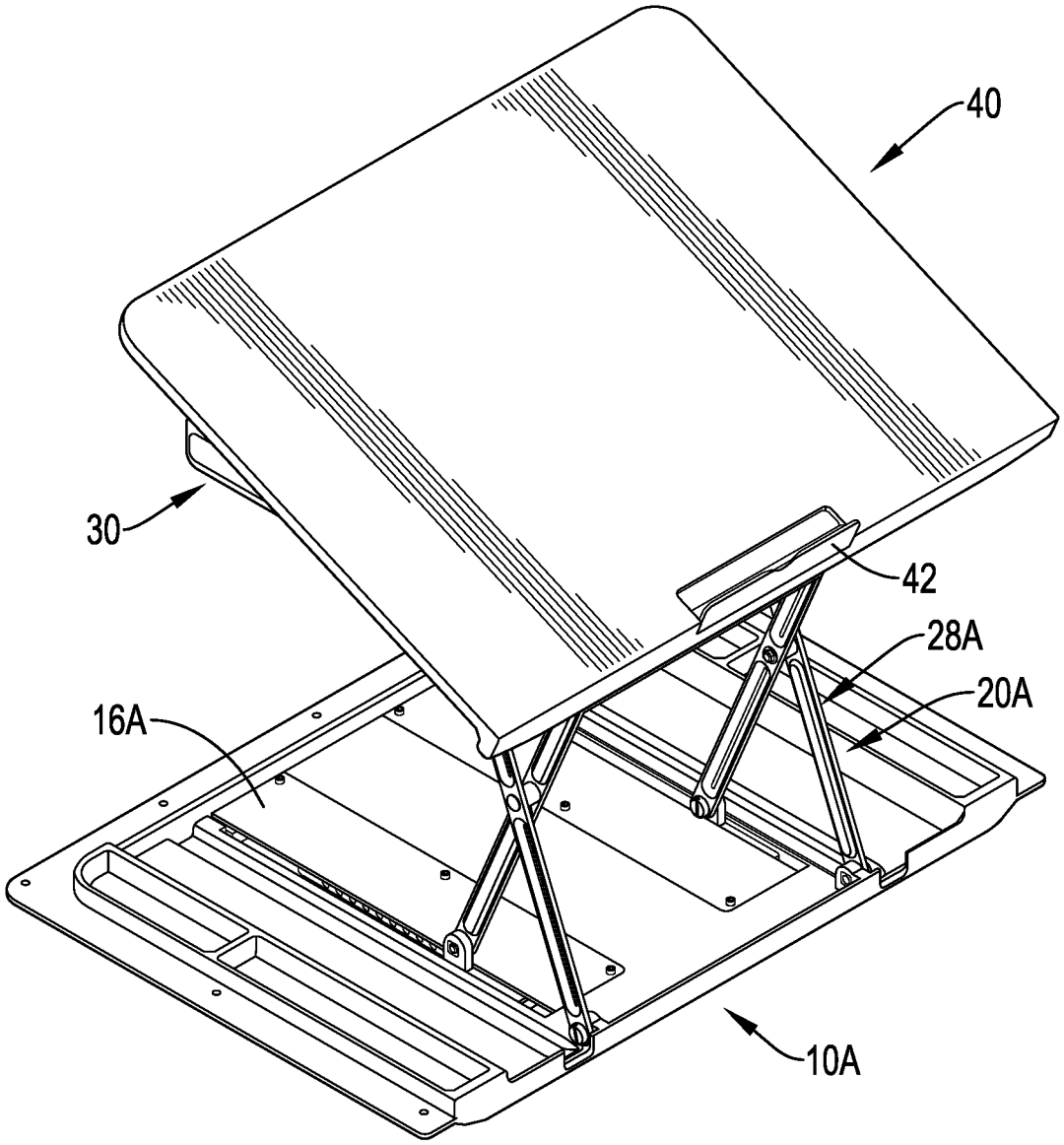
FIG. 11 is a perspective view of a second embodiment of a foldable table in accordance with the present invention in an expanded state.
Figure 12:
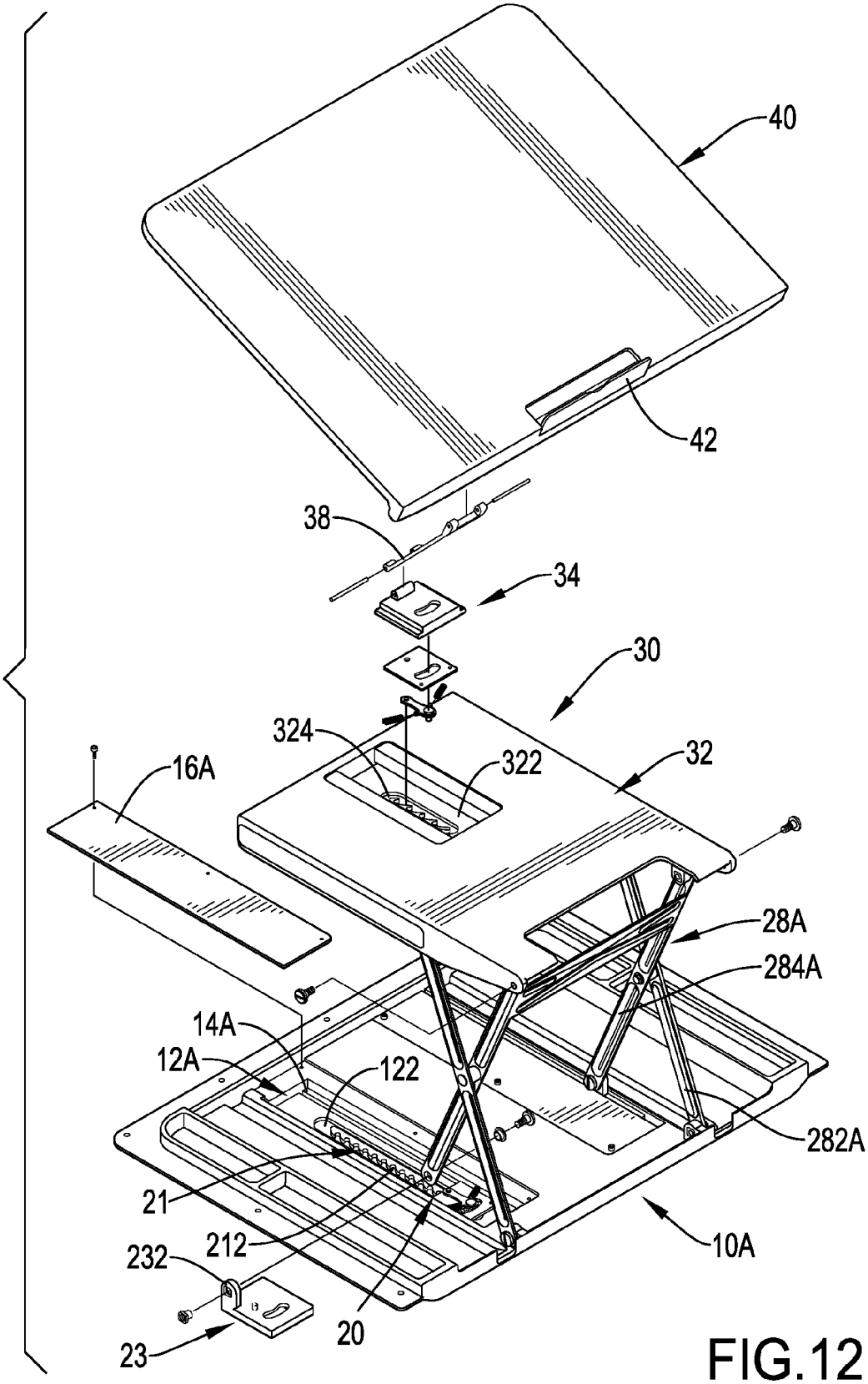
FIG. 12 is a partially exploded perspective view of the foldable table in FIG. 11.
Figure 13:
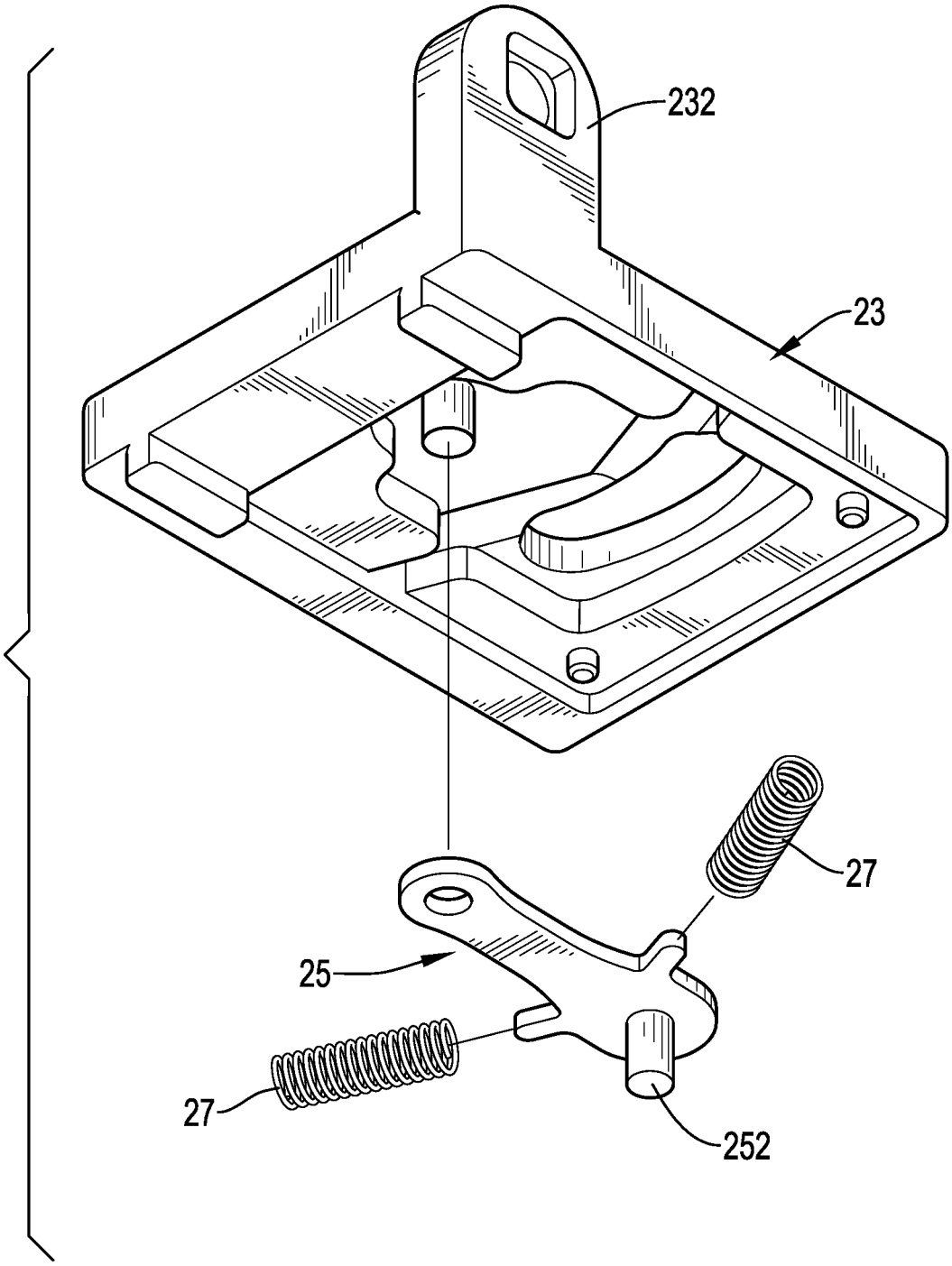
FIG. 13 is an enlarged exploded perspective view of the lifting slider of the foldable table in FIG. 12.

With reference to FIGS. 11 to 13, in the second embodiment, the lifting device 20A comprises multiple lifting racks 21, multiple lifting sliders 23, and multiple lifting rods 28A. The base 10A has multiple slider recesses 12A defined in the top of the base 10A. Each slider recess 12A has a bottom and a rack recess 122 defined in the bottom of the slider recess 12A and having a bottom and two opposite sides.

The multiple lifting racks 21 are mounted on the base 10A, are preferably mounted respectively in the rack recesses 122, and are parallel with each other. Each lifting rack 21 has an engaging side provided with multiple teeth 212 and a flat side opposite the engaging side. The engaging side and the flat side of each lifting rack 21 are spaced respectively from the opposite sides of a corresponding one of the rack recesses 122 to define two sliding channels between the lifting rack and the corresponding rack recess. Each lifting rack 21 has two curved ends. The lifting sliders 23 are moveably mounted on the base 10A, are moveable respectively relative to the lifting racks 21, and are preferably mounted moveably respectively in the slider recesses 12A. Each lifting slider 23 has a bottom, an engaging block 25, and two resilient elements 27. The engaging block 25 is pivotally mounted on the bottom of the adjusting slider 23 and has an engaging post 252 formed on the engaging block 25 and selectively engaging with one of the teeth 212 on a corresponding one of the lifting racks 21. The resilient elements 27 are mounted on the bottom of the adjusting slider 23 and are connected respectively with two sides of the engaging block 25. In addition, each slider recess 12A has two opposite sides and two rails 14A mounted respectively on the sides of the slider recess 12A and being parallel with each other. Each lifting rack 21 is parallel with the rails 14A in a corresponding one of the slider recesses 12A. Each lifting slider 23 is moveably connected with the rails 14A in a corresponding one of the slider recesses 12A. The base 10A further has a top cover 16A mounted on the top of the base 10A and closing the slider recesses 12A.

The lifting rods 28A are divided into multiple pairs. Each pair of the lifting rods 28A includes a first lifting rod 282A and a second lifting rod 284A pivotally connected with the first lifting rod 282A. The first lifting rod 282A of each pair of the lifting rods 28A is pivotally connected with the base 10A, and the second lifting rod 284A of each pair of the lifting rods 28A is pivotally connected with one of the lifting sliders 23. Additionally, each lifting slider 23 further has multiple pivotal ears 232 formed on the lifting slider 23 and pivotally connected with the second lifting rods 284A of the pairs of the lifting rods 28A.

Figure 14:
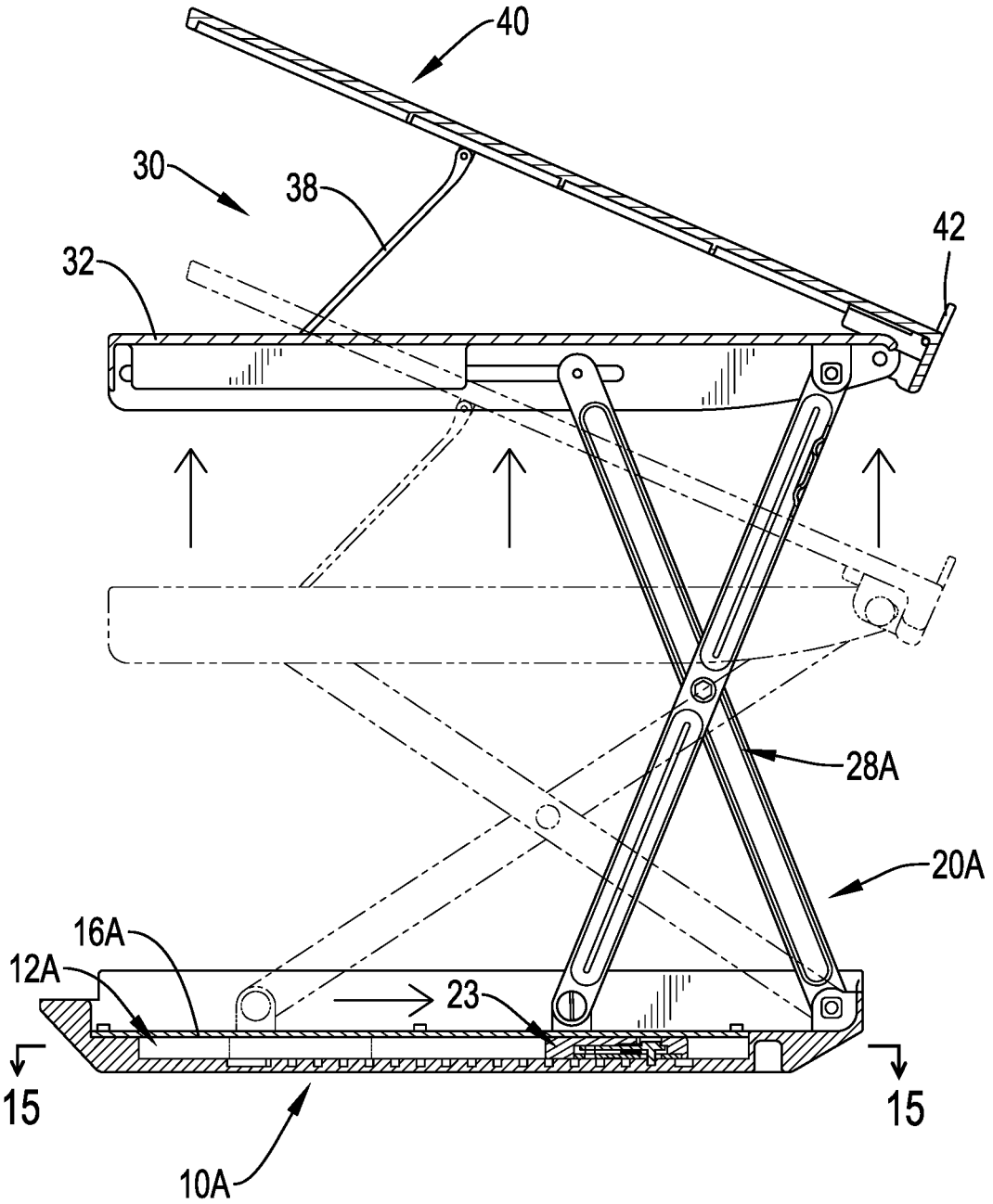
FIG. 14 is an operational side view in partial section of the foldable table in FIG. 11.
Figure 15:
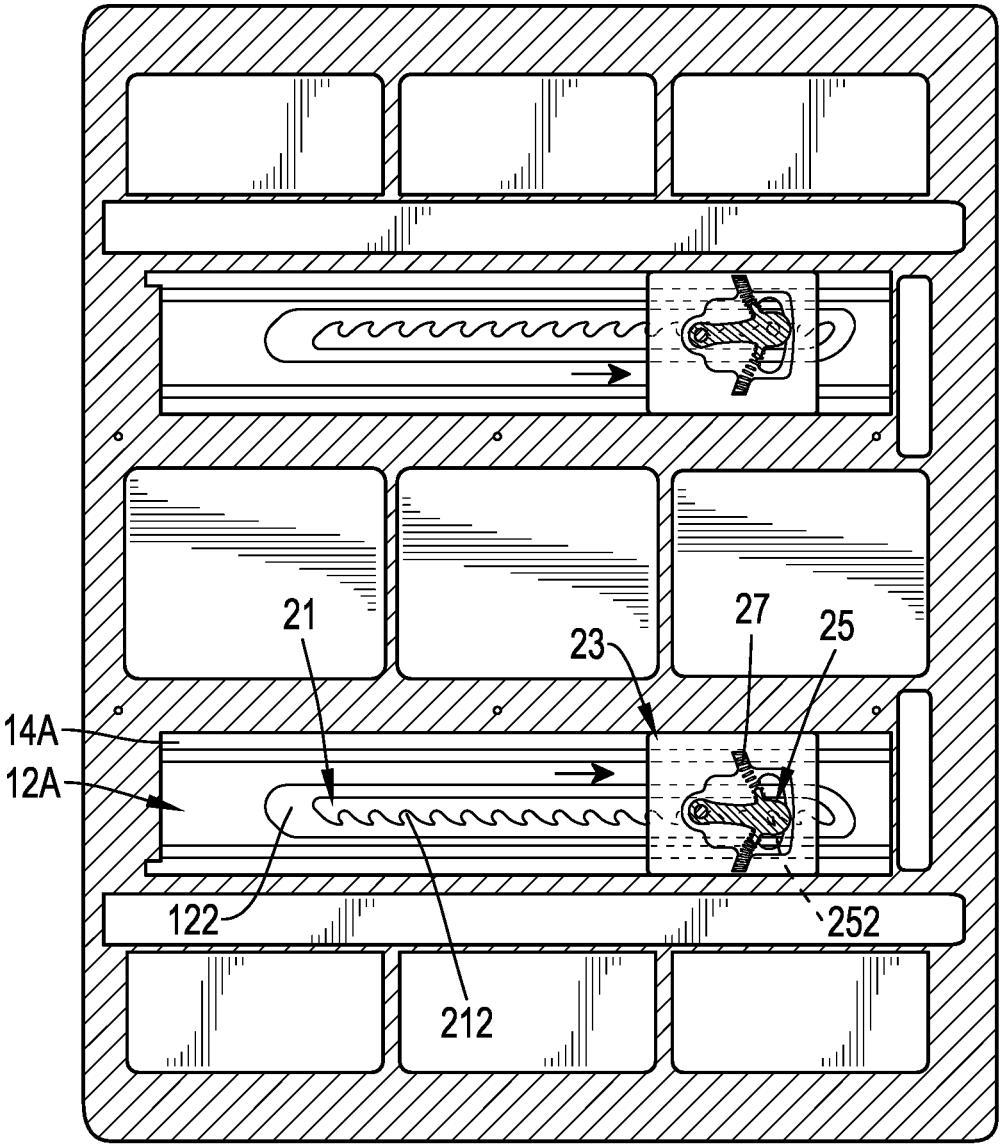
FIG. 15 is an operational top view of in partial section the foldable table along the line 15-15 in FIG. 14.

To expand the table, with reference to FIGS. 12, 14, and 15, the adjusting board 32 is moved upward, such that the lifting sliders 23 are moved relative to the base 10A and the lifting racks 21 along the rails 14A via the transmission of the lifting rods 28A. While the lifting sliders 23 are moving along the lifting racks 21, the engaging post 252 on the engaging block 25 of each lifting slider 23 will move over the teeth 212 on the engaging side of the corresponding lifting rack 21 with the resilient force provided by the resilient elements 27. When the supporting board 32 is moved to a desired height and is stopped moving, the engaging post 252 on the engaging block 25 of each lifting slider 23 will engage with one of the teeth 212 of the corresponding lifting rack 21 by the resilient force provided by the resilient elements 27. Accordingly, the adjusting board 32 and the supporting board 40 are positioned at the desired height. After the supporting board 40 is pivoted relative to the adjusting board 32, a user can operate a portable device on the inclined supporting board 40.

The way of expanding and folding the lifting device 20A of the second embodiment is similar to that of the adjusting assembly 30, so the detail of the way of expanding and folding the lifting device of the second embodiment is omitted.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foldable table comprising:

a base;

a lifting device mounted on the base and having a top;

an adjusting assembly pivotally connected with the lifting device and comprising an adjusting board pivotally connected with the top of the lifting device;

an adjusting rack mounted on the adjusting board and having two opposite sides, the two opposite sides of the adjusting rack being an engaging side provided with multiple teeth and a flat side opposite to the engaging side;

an adjusting slider moveably mounted on the adjusting board and having a bottom;

an engaging block pivotally mounted on the bottom of the adjusting slider and having an engaging post formed on the engaging block and selectively engaging with one of the teeth on the adjusting rack;

two resilient elements mounted on the bottom of the adjusting slider and connected respectively with two sides of the engaging block; and a connection arm having a top end and a bottom end, the bottom end connected pivotally with the adjusting slider;

a supporting board pivotally connected with the adjusting board, pivotally connected with the top end of the connection arm, and having a pivoting edge pivotally connected with the adjusting board; and a supporting block pivotally mounted on the pivoting edge of the supporting board.

2. The foldable table as claimed in claim 1, wherein the lifting device comprises a driving device mounted on the base;

a threaded rod mounted rotatably on the base and connected with and driven by the driving device;

a moving base mounted moveably on the base and having a threaded hole screwed with the threaded rod; and multiple lifting rods divided into multiple pairs, and each pair of the lifting rods including a first lifting rod and a second lifting rod pivotally connected with the first lifting rod, wherein the first lifting rod of each pair of the lifting rods is pivotally connected with the base, and the second lifting rod of each pair of the lifting rods is pivotally connected with the moving base;

the adjusting board is pivotally connected with tops of the lifting rods; and the first lifting rod of each pair of the lifting rods is slidably connected with the adjusting board.

3. The foldable table as claimed in claim 2, wherein the base has a base recess defined in a top of the base;

the moving base is moveably mounted in the base recess; and the threaded rod extends into the base recess.

4. The foldable table as claimed in claim 3, wherein the base recess has two opposite sides and two rails mounted respectively on the two opposite sides of the base recess and being parallel with each other;

the threaded rod is parallel with the rails; and the moving base is moveably connected with the rails.

5. The foldable table as claimed in claim 4, wherein the moving base further has multiple pivotal ears formed on the moving base and pivotally connected with the second lifting rods of the pairs of the lifting rods.

6. The foldable table as claimed in claim 5, wherein the base further has a top cover mounted on the top of the base and closing the base recess.

7. The foldable table as claimed in claim 6, wherein the adjusting board has a top and a sliding recess defined in the top of the adjusting board and having a bottom;

a rack recess is defined in the bottom of the sliding recess and has a bottom and two opposite sides;

the adjusting rack is mounted on the bottom of the rack recess; and the engaging side and the flat side of the adjusting rack are spaced respectively from the opposite sides of the rack recess to define two sliding channels, one of the two sliding channels is defined between one of the two opposite sides of the rack recess and the engaging side of the adjusting rack, and the other one of the two sliding channels is defined between the other one of the two opposite sides of the rack recess and the flat side of the adjusting rack.

8. The foldable table as claimed in claim 7, wherein the adjusting rack has two curved ends.

9. The foldable table as claimed in claim 1, wherein the lifting device comprises multiple lifting racks mounted on the base and being parallel with each other, and each lifting rack having two opposite sides, the two opposite sides of the lifting rack being an engaging side provided with multiple teeth and a flat side opposite to the engaging side of the lifting rack;

multiple lifting sliders moveably mounted on the base and being moveable respectively relative to the lifting racks, and each lifting slider having a bottom;

an engaging block pivotally mounted on the bottom of the adjusting slider and having an engaging post formed on the engaging block of the lifting slider and selectively engaging with one of the teeth on a corresponding one of the lifting racks;

two resilient elements mounted on the bottom of the adjusting slider and connected respectively with two sides of the engaging block of the lifting slider; and multiple lifting rods divided into multiple pairs, and each pair of the lifting rods including a first lifting rod and a second lifting rod pivotally connected with the first lifting rod, wherein the first lifting rod of each pair of the lifting rods is pivotally connected with the base, and the second lifting rod of each pair of the lifting rods is pivotally connected with one of the lifting sliders;

the adjusting board is pivotally connected with tops of the lifting rods; and the first lifting rod of each pair of the lifting rods is slidably connected with the adjusting board.

10. The foldable table as claimed in claim 9, wherein the base has multiple slider recesses defined in a top of the base;

the lifting sliders are moveably respectively mounted in the slider recesses; and the lifting racks are respectively mounted in the slider recesses.

11. The foldable table as claimed in claim 10, wherein each slider recess has a bottom and a rack recess defined in the bottom of the slider recess and having a bottom and two opposite sides;

the lifting racks are mounted respectively on the bottoms of the rack recesses in the slider recesses; and the engaging side and the flat side of each lifting rack are spaced respectively from the opposite sides of a corresponding one of the rack recesses to define two sliding channels, one of the two sliding channels is defined between one of the engaging side of the lifting rack and one of the opposite sides of the corresponding rack recess, and the other one of the two sliding channels is defined between the flat side of the lifting rack and the other one of the opposite sides of the corresponding rack recess.

12. The foldable table as claimed in claim 11, wherein each lifting rack has two curved ends.

13. The foldable table as claimed in claim 12, wherein each slider recess has two opposite sides and two rails mounted respectively on the two opposite sides of the slider recess and being parallel with each other;

each lifting rack is parallel with the rails in a corresponding one of the slider recesses; and each lifting slider is moveably connected with the rails in a corresponding one of the slider recesses.

14. The foldable table as claimed in claim 13, wherein each lifting slider further has multiple pivotal ears formed on the lifting slider and pivotally connected with the second lifting rods of the pairs of the lifting rods.

15. The foldable table as claimed in claim 14, wherein the base further has a top cover mounted on the top of the base and closing the slider recesses.

16. The foldable table as claimed in claim 15, wherein the adjusting board has a top and a sliding recess defined in the top of the adjusting board and having a bottom;

a rack recess is defined in the bottom of the sliding recess and has a bottom and two opposite sides;

the adjusting rack is mounted on the bottom of the rack recess; and the engaging side and the flat side of the adjusting rack are spaced respectively from the opposite sides of the rack recess to define two sliding channels, one of the two sliding channels is defined between the two opposite sides of the rack recess and the engaging side of the adjusting rack, and the other one of the two sliding channels is defined between the other one of the two opposite sides of the rack recess and the flat side of the adjusting rack.

* * * * *